US005157939A

United States Patent [19]

Lyon et al.

[11] Patent Number: 5,157,939

[45] Date of Patent: Oct. 27, 1992

[54] ICE MAKING APPARATUS

[75] Inventors: Douglas J. Lyon, Yeronga; Stefan S. Jensen, Wavel Heights; Jeffrey B. Cage, Tarragindi; Robert R. Niblock, Coorparoo, all of Australia

[73] Assignee: Heat and Control Pty. Ltd., Mt. Gravatt, Australia

[21] Appl. No.: 458,670

[22] Filed: Jul. 6, 1990

[30] Foreign Application Priority Data

Jul. 31, 1987 [AU] Australia ..... PI3458

[51] Int. Cl.[5] ..... F25C 5/12

[52] U.S. Cl. ..... 62/345; 62/354

[58] Field of Search ..... 62/345, 354; 165/94

[56] References Cited

U.S. PATENT DOCUMENTS

| | | | |
|---|---|---|---|
| 3,159,986 | 12/1964 | King | 62/354 |
| 3,191,398 | 6/1965 | Rader | 62/138 |
| 3,797,267 | 3/1974 | Hagen | 62/233 |
| 3,863,462 | 2/1975 | Treuer | 62/345 |
| 4,292,816 | 10/1981 | Gartzke | 62/345 |
| 4,365,485 | 12/1982 | Samuelsen | 62/320 |
| 4,669,277 | 6/1987 | Goldstein | 62/354 |

FOREIGN PATENT DOCUMENTS

| | | |
|---|---|---|
| 163207 | 9/1905 | Fed. Rep. of Germany . |
| 146336 | 7/1982 | Norway . |
| 344744 | 4/1960 | Switzerland . |
| 1179586 | 1/1970 | United Kingdom . |

*Primary Examiner*—William E. Tapoloai

*Attorney, Agent, or Firm*—Flehr, Hohbach, Test, Albritton & Herbert

[57] ABSTRACT

Apparatus for continuous production of flake ice comprises one or more refrigerated discs mounted on a hollow shaft. Each disc rotates in the vertical plane and includes a plurality of narrow internal channels which extend substantially over all of the operative portion of the disc and are of substantially equal length. The discs form the evaporator of a refrigeration circuit, and an evaporative refrigerant is circulated to the channels in each disc via the hollow shaft. During each cycle, water is applied to both external flat surfaces of each disc at a first angular location and the film of water which adheres thereto freezes as the disc rotates. The ice sheet so formed is removed from both sides of the disc at a second angular location by scraper blades.

8 Claims, 10 Drawing Sheets

ICE MAKING APPARATUS

The present invention relates to ice making apparatus. In particular, the invention is directed to a machine for making flake ice.

BACKGROUND OF THE INVENTION

Flake ice is made in this sheets approximately 1.56–6.0 mm thick. The sheets may be curved or flat and the thin ice is generally broken into random-sized flakes when harvested.

Flake ice is particularly suitable for packing products such as fish or frozen foods as the ice flakes can be packed close to the products In other applications such as chemical processing and concrete cooling, where rapid cooling is important, flake ice is ideal because the flakes present the maximum amount of cooling surface for a given amount of ice.

Flake ice is commonly produced by the application of water to the inside or outside of a refrigerated cylindrical drum. The water is applied at a first angular location on the drum and adheres thereto in a thin layer by surface tension. As the drum rotates, the water freezes into a thin layer of ice, which is fractured by an ice removal device at a second angular location downstream from the first angular location in the direction of rotation.

The thickness of the flake ice can be varied by adjusting the speed of the rotating drum, varying the evaporator temperature, and regulating the water flow on to the freezing surface. Since flake ice can be made in a continuous operation without being interrupted for a harvest cycle, less refrigeration tonnage is required to produce a tonne of ice than any other type of manufactured ice when similar make up water and evaporating temperatures are compared.

In known machines, water is applied to only one side of the drum, i.e. either the outside or inside, but not both. As a result, the refrigerated surface on the other side of the drum is unused, and the ice making operation represents an inefficient use of the refrigeration capacity of the machine.

Furthermore, as the ice removal device is located Only on the side of the drum on which ice is formed, the continual unbalanced force applied to that side of the drum to fracture the ice from the freezing surface accelerates the wear on the drum bearings.

A further disadvantage of known ice making machines of the drum type is that their capacity cannot be readily increased. If increased capacity is desired, it is usually necessary to install a whole new machine. That is, in addition to installing an extra refrigerated drum, it is also necessary to install another refrigeration unit including motor, compressor and condensor, and a new drive unit. Any upgrading in capacity will therefore involve considerable expense.

With a view to overcoming the above described problems and increasing the production capacity of ice making machines, it has been proposed to use refrigerated discs. U.S. Pat. No. 3,863,462 describes a large scale flake ice producing machine which comprises one or more upright refrigerated discs rotatable on a horizontal shaft. Water or other congealable liquid is applied to both surfaces of the disc and frozen into sheets of ice as the disc rotates. Thereafter, the sheets are removed from the disc in ice flakes. Each disc is approximately 1.8 m in diameter and comprises a pair of large round aluminium plates spaced apart about 20 mm and sealed at their periphery to form an enclosed space. Baffles are placed within the interior of the space to form rudimentary passages through which a coolant is pumped in order to refrigerate the disc surfaces.

However, the flake ice producing machine of U.S. Pat. No. 3,863,462 possesses several inherent disadvantages, including:

(a) Due to the large flow passages inside the disc, it is necessary to use a non-evaporative coolant such as brine or glycol. That is, a "boiling" or evaporative refrigerant which cools by direct expansion is not suitable for use in the disc of U.S. Pat. No. 3,863,462. Brine and glycol have low cooling capacity and large amounts of such coolants must be pumped through the disc in order to achieve the required cooling.

(b) Since a coolant such as brine or glycol must be used, a separate refrigeration plant is required in order to chill the brine or glycol.

(c) The discs are difficult to manufacture according to the tolerances required. The 1.8 m diameter discs must be cast and machined, and welded at their periphery, yet the flat outer surfaces of the discs must not vary from the plane in which they rotate by more than 1.8 mm.

For the foregoing reasons, the ice making machine of U.S. Pat. No. 3,863,462 is not considered to be commercially acceptable.

It is an object of the present invention to overcome or ameliorate at least some of the abovedescribed disadvantages of the prior art by providing an improved ice making machine.

It is another object of the present invention to provide an improved refrigerated disc for use with the ice making machine.

SUMMARY OF THE INVENTION

According to a first aspect of the present invention, there is provided an ice making apparatus comprising at least one rotatable refrigerated disc member; means for applying liquid to both sides of said disc member at a first location, whereby at least some of said liquid adheres to both surfaces of said disc member and is frozen as said disc member rotates; and means for removing the frozen liquid from the sides of said disc member at a second location angularly displaced from said first location in the direction of rotation; characterised in that each said disc member has a plurality of relatively narrow internal channels for passage of an evaporative coolant therethrough, said channels extending substantially over all of the operative portion of the disc member.

Typically, the liquid applied to the disc member is water which is frozen to form ice. The ice is removed in the form of flake ice as hereinbefore described.

The water may be applied to the surface of the disc by rotating the disc through a water trough or the like. Alternatively, the water may be sprayed onto the disc.

Preferably, the ice removal means comprises a pair of harvesting blades juxtaposed with, and extending radially along respective opposite sides of the disc. Each harvesting blade does not contact the disc but is spaced therefrom by a small clearance, typically 0.05–1.0 mm. The ice is removed without introduced heat.

As the disc rotates, each point on the operative surfaces of the disc will undergo the following steps in sequence: (1) water will be applied to the disc surface, (2) the water will freeze into ice as the disc rotates with time, (3) the ice will be removed by the ice removal means, and the above sequence is repeated with each revolution of the disc in a continuous process.

It will be apparent to those skilled in the art that ice making apparatus of the present invention has few moving parts and is relatively economical to manufacture.

Furthermore, the ice making apparatus is able to utilize direct expansion refrigeration with a "boiling" or evaporative refrigerant thereby enabling higher efficiency and freezing capacity to be achieved Only one refrigeration system is required, the disc(s) constituting the evaporator of the refrigeration system.

According to a second aspect of the invention, there is provided a refrigerating disc suitable for use in an ice making machine, said disc having a plurality of relatively narrow internal channels for passage of an evaporative coolant therethrough, said channels extending substantially over all of the operative portion of the disc.

The disc typically is circular in shape and is adapted for rotation about an axis passing through its geometric centre.

Preferably, the disc is of sandwich or laminate construction comprising two halves in which open channels have been etched or machined in patterns which are mirror images of each other. When the two halves are sandwiched together to form the composite disc, opposed open channels form closed internal channels. The pattern of the channels is such that they extend over substantially all of the plane of the disc and are substantially of equal length so that the disc is cooled evenly.

In a single disc machine, the refrigerated disc has a central aperture having a collar fitted therein. On one side, the collar receives a hollow shaft delivering the compressed refrigerant. The collar has a series of radial bores, communicating at their inner ends with the hollow shaft. At their outer ends, the radial bores communicate with respective inlets to the channels extending through the disc, the channel inlets being located on the cylindrical surface of the disc aperture. The liquid refrigerant passes through the hollow shaft and into the internal channels of the disc whereat it evaporates to thereby cool the disc.

The channel outlets communicate with another hollow shaft on the opposite side of the collar via a second set of radial bores in the collar. The evaporated refrigerant is extracted through this hollow shaft to the compressor. The disc, collar and shafts form a single assembly which is rotated by a motor using a belt or chain drive to a pulley or sprocket on one of the shafts.

However, the disc can be rotated in any other suitable manner. For example, the disc can be provided with a toothed perimeter so that the disc can be driven by a cogwheel gear, either directly or chain-driven.

In a multiple disc machine, a number of discs are mounted on a common shaft and refrigerant is fed to the channels in each disc via a distributer and pipe lead system. The discs are fed in parallel, and the lengths of the pipe leads are made substantially equal to ensure equal pressure drop in the refrigerant feed to the discs. The evaporated refrigerant can be extracted via the common hollow shaft.

Preferred embodiments of the invention will now be described by way of example with reference to the accompanying drawings.

DESCRIPTION OF PREFERRED EMBODIMENT

Figure 1:
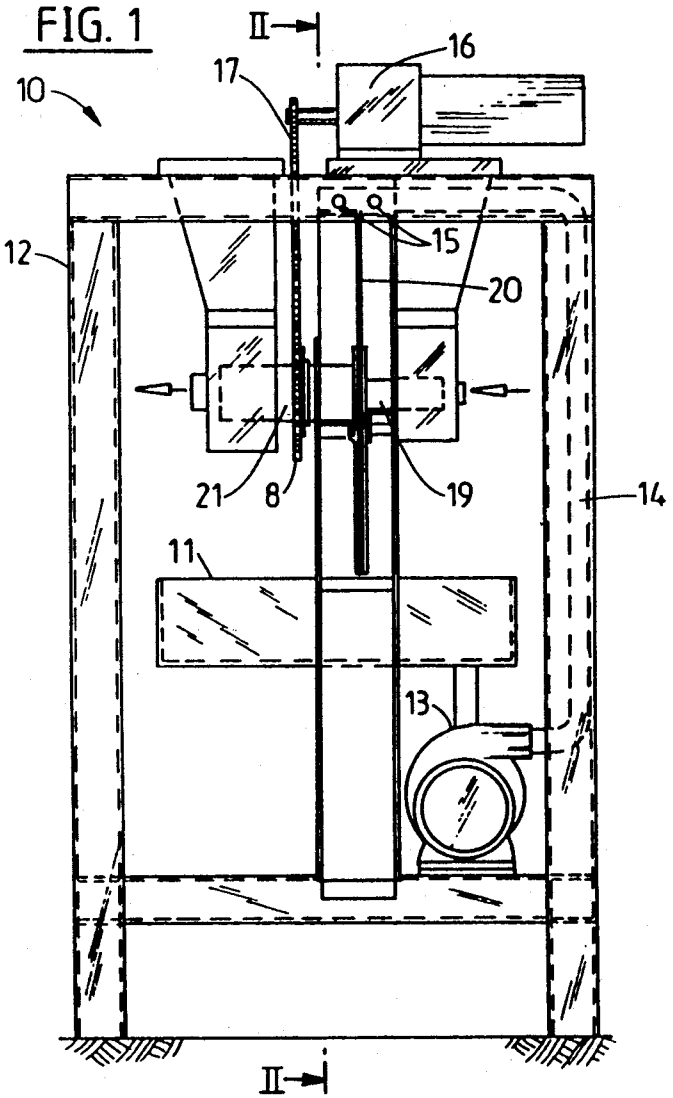
FIG. 1 is a side elevational view of the ice making apparatus of one embodiment of the invention.
Figure 2:
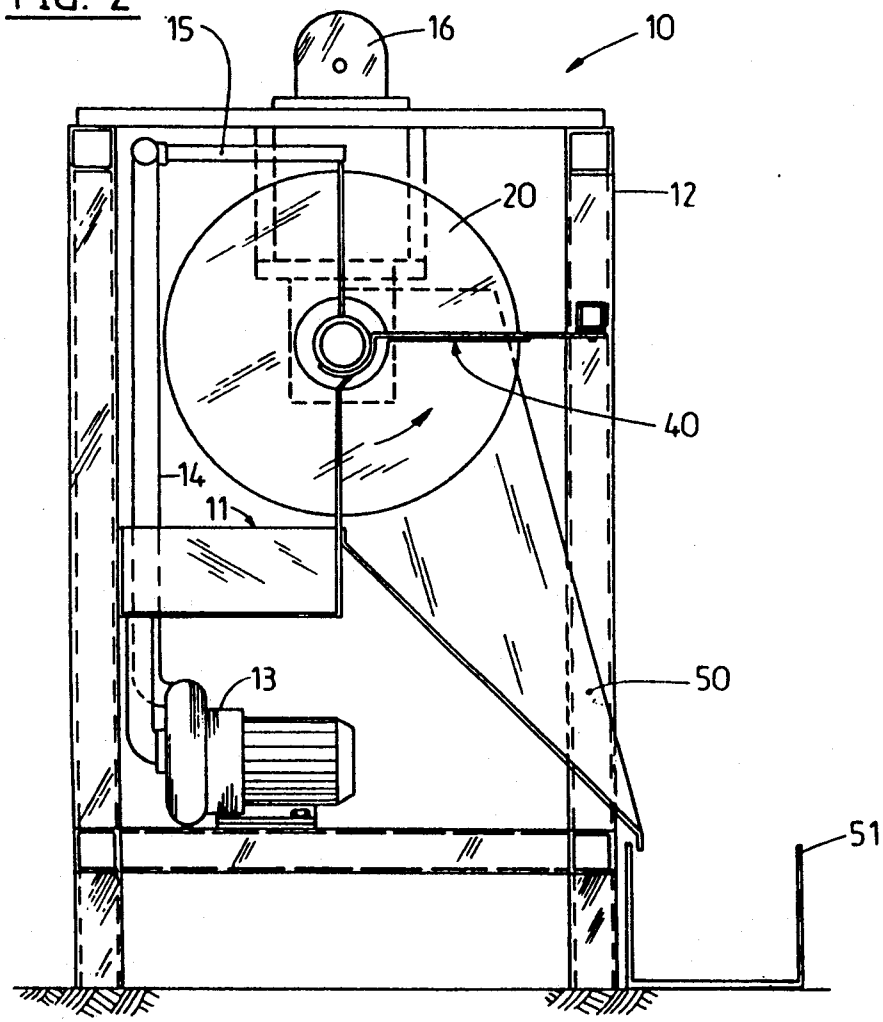
FIG. 2 is a sectional elevational view along A—A of FIG. 1.

As shown in the FIGS. 1 and 2, the ice making machine 10 of a first embodiment of the invention comprises a frame 12 on which are mounted a water reservoir 11 and a pump 13. Water from the reservoir 11 is pumped by pump 13 through upwardly extending pipe 14 to a pair of water sprays 15 located above and on respective sides of a rotating refrigerated disc 20. The water sprays are oriented to direct water onto both surfaces of the disc to thereby leave a film of water adhering to both disc surfaces. The disc 20 rotates in the direction indicated by the arrow in FIG. 1 and is driven by motor 16 via a belt or chain 17 and pulley 18. However, the disc 20 may be rotated by any other suitable means. For example, the disc 20 may be provided with a toothed perimeter and driven by a cog-wheel gear either directly or by chain.

The refrigerated disc 20 has a plurality of channels therein and constitutes the evaporator in a refrigeration circuit. The mounting of the refrigerated disc 20 is shown in more detail in FIG. 3. As can be seen in that drawing, the disc 20 has a central circular aperture having a circular collar 22 inserted therein. On one side, the collar 22 receives a hollow shaft 18 delivering refrigerant while on its other side, the collar 22 receives another hollow shaft 21 for removing the evaporated refrigerant. The shafts 18, 21, collar 22 and disc 20 are fixed relative to each other and rotate as a single assembly. To enable rotation, shaft 18 is mounted in bearing 25 while shaft 21 is mounted in bearing 23. The bearings 23, 25 are located in respective bearing blocks which preferably are adjustably and removably mounted within the frame 12 of the ice making machine. Hollow shafts 18 and 21 communicate respectively with the condensor and compressor (not shown) of a refrigeration circuit. O-rings 26, 24 are provided to seal the connections to the shafts 18, 21 respectively.

Shaft 21 has attached thereto a pulley, sprocket or cog 18 which is rotated by motor 16 via belt or chain 17. Rotation of the pulley 18 in turn rotates the disc/collar/pipe assembly.

Figure 4:
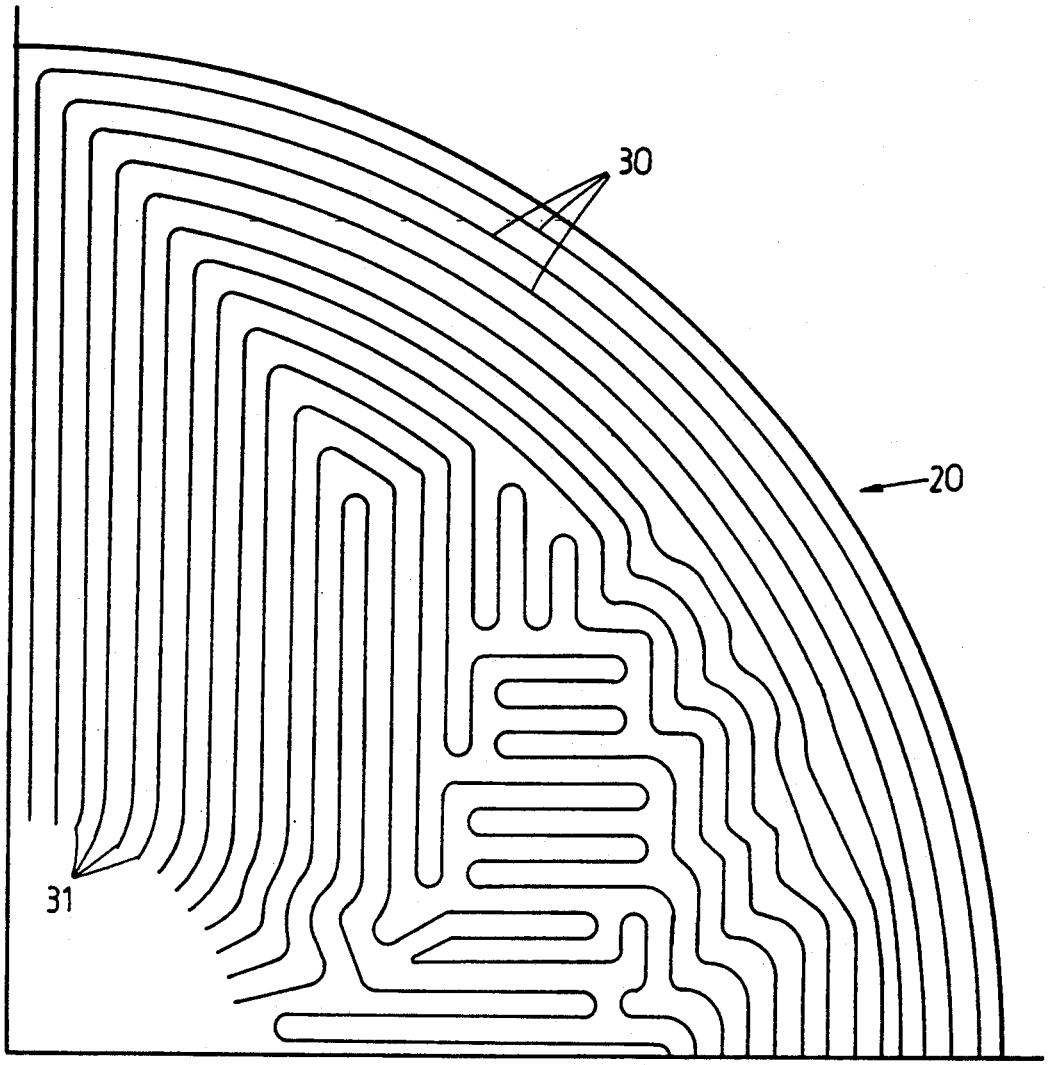
FIG. 4 is a sectional view of a quadrant of the disc of the ice making apparatus of FIG. 1.
Figure 5:
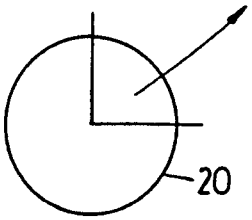
FIG. 5 is a sectional view of part of the disc of FIG. 4.
Figure 5:
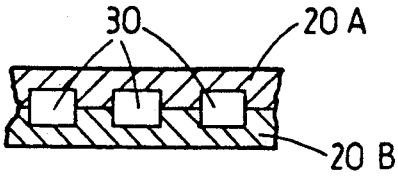
Figure 6:
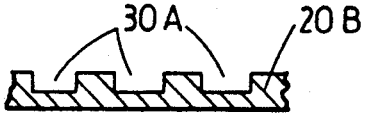
FIG. 6 is a sectional view of part of one half disc of FIG. 4.

The refrigerated disc 20 is shown in more detail in FIGS. 4–6. The disc 20 is of laminated construction and comprises two discs 20A and 20B sandwiched together. Each disc 20A, 20B has a pattern of open channels 30A formed in a surface thereof, for example by etching or machining. The channel patterns are mirror images of each other so that when the discs 20A and 20B are bonded together, closed channels 30 are formed. The disc is typically 4–10 mm thick, and the channels are typically 3.5 mm wide×2.5 mm high.

The channel pattern for a quadrant of the disc 20 is shown in FIG. 4. The pattern for the bottom right quadrant is the inverse to the illustrated pattern for the top right quadrant, and the patterns for the top and bottom left quadrants are mirror images of the patterns for the top and bottom right quadrants, respectively. The channel pattern is so designed that (a) the channels are spread over substantially the whole operative surface of the disc so that all points on the surface are close to the refrigerant, and (b) the channels are of substantially equal length so that there is uniform pressure drop in the refrigerant in all the channels.

These two features ensure that the disc is refrigerated as uniformly and evenly as possible. Moreover, the provision of a pattern of thin channels enables the disc to be refrigerated using an evaporative or "boiling" refrigerant as opposed to brine. Faster and more efficient cooling of the disc is therefore obtained.

Although the illustrated disc is composed of two layers, more than two layers can be used to form the laminated disc if desired.

Each channel 30 has an inlet 31 communicating with the central aperture in the disc. The outlets of the channels 30 are also located on the inner cylindrical surface of the disc, on the opposite side to the inlets.

Figure 3:
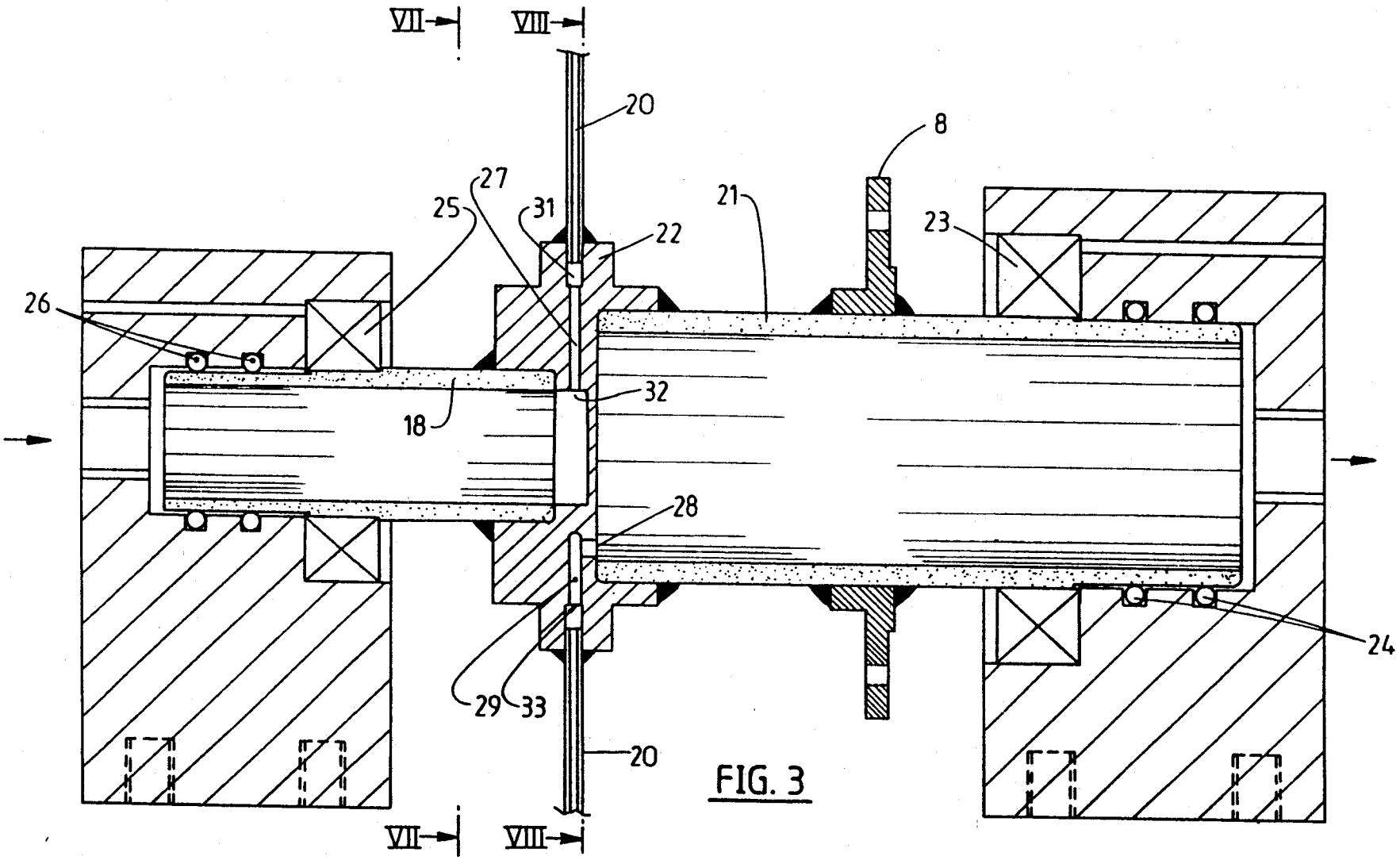
FIG. 3 is a sectional side elevational view of the disc mounting arrangement of FIG. 1.
Figure 8:
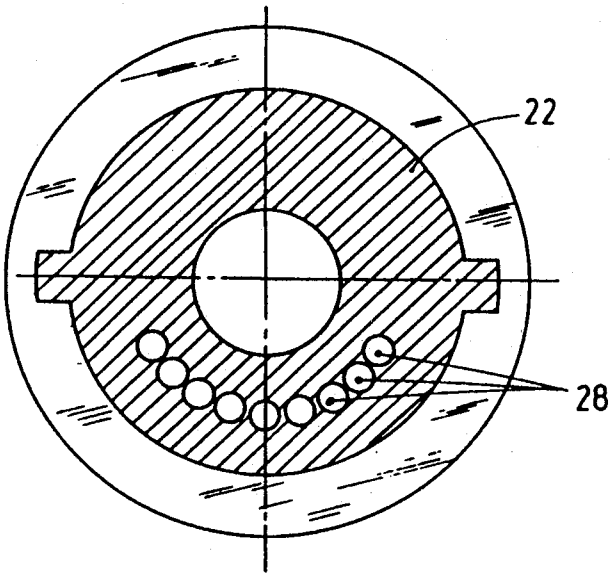
FIG. 8 is a sectional elevational view along C—C of FIG. 3.
Figure 7:
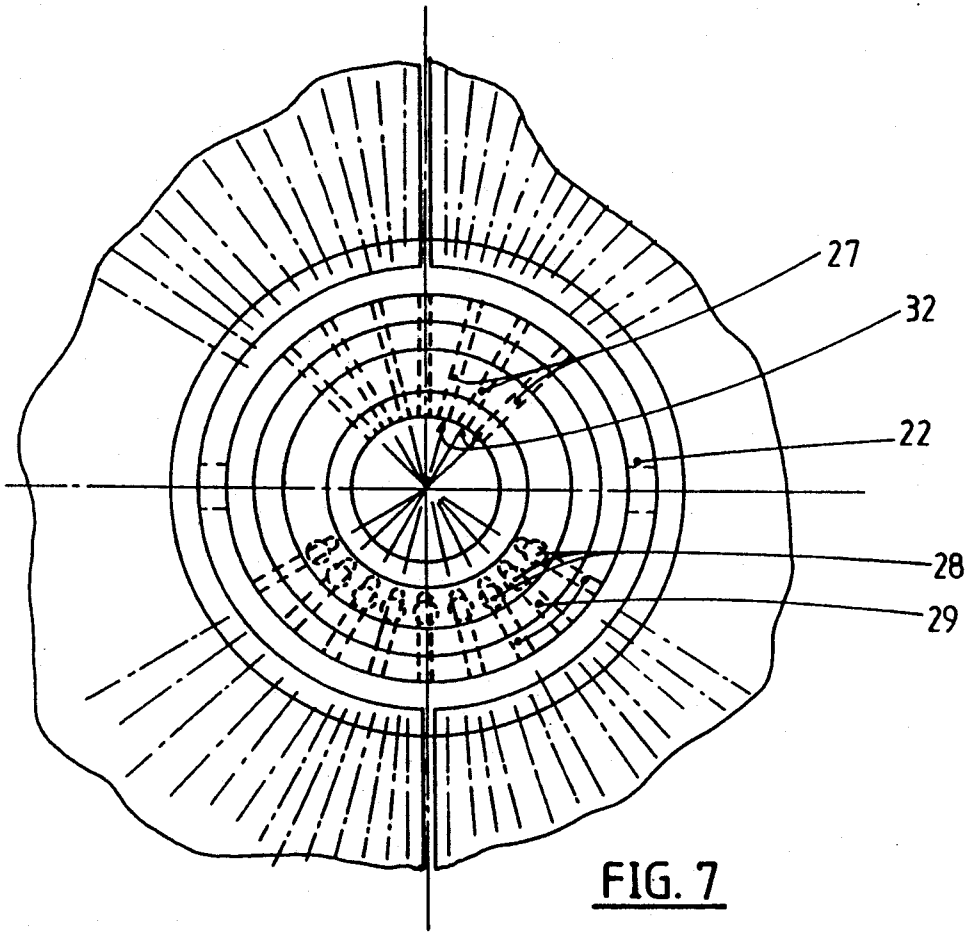
FIG. 7 is a sectional elevational view along B—B of FIG. 3.

As shown in FIGS. 3, 7 and 8, the collar 22 has a plurality of radial bores 27 on one half which communicate at their inner ends 32 with the hollow shaft 18 and at their outer ends with the inlets 31 of the channels 30 in the disc 20. On the opposite half, the collar 22 is provided with a plurality of radial bores 29 having outer ends communicating with the outlets 33 of channels 30 and inner ends communicating with axial bores 28 which, in turn, communicate with the hollow shaft 21.

Condensed liquid refrigerant is fed via shaft 18 through radial bores 27 in the collar 22 and into the channels 30 in the disc 20 where it evaporates to cool the disc. The evaporated refrigerant is drawn from the channel outlets 33 through bores 20 and 28 and out through the hollow shaft 21 to the compressor (not shown) in the refrigeration circuit. In this manner, the disc acts as the evaporator in the refrigeration circuit.

As shown in FIG. 2, ice removal means 40 are mounted on frame 12 for fracturing the ice formed on the disc from the refrigerated surfaces. After being broken off the disc, the ice falls down chute 50 to be collected in ice bin 51.

Figure 9:
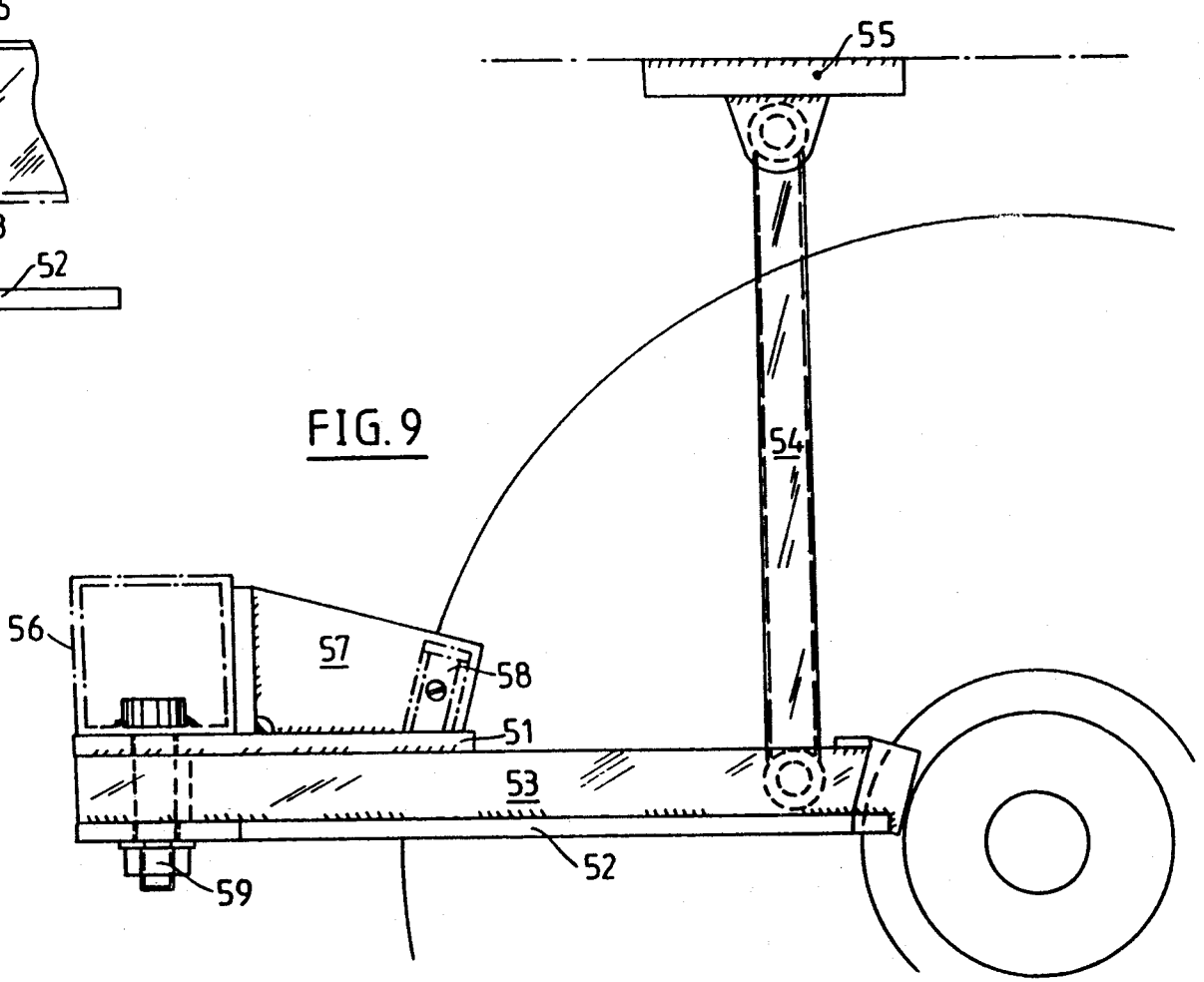
FIG. 9 is an elevational view of the ice removal means of FIG. 2.
Figure 10:
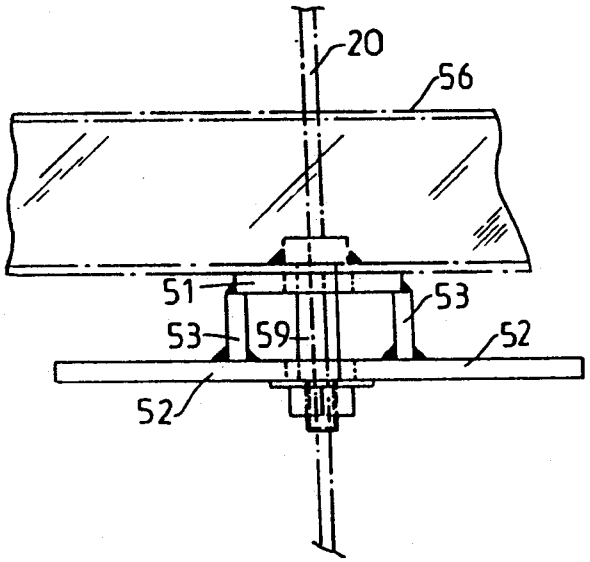
FIG. 10 is an end elevational view of the ice removal means of FIG. 9.
Figure 11:
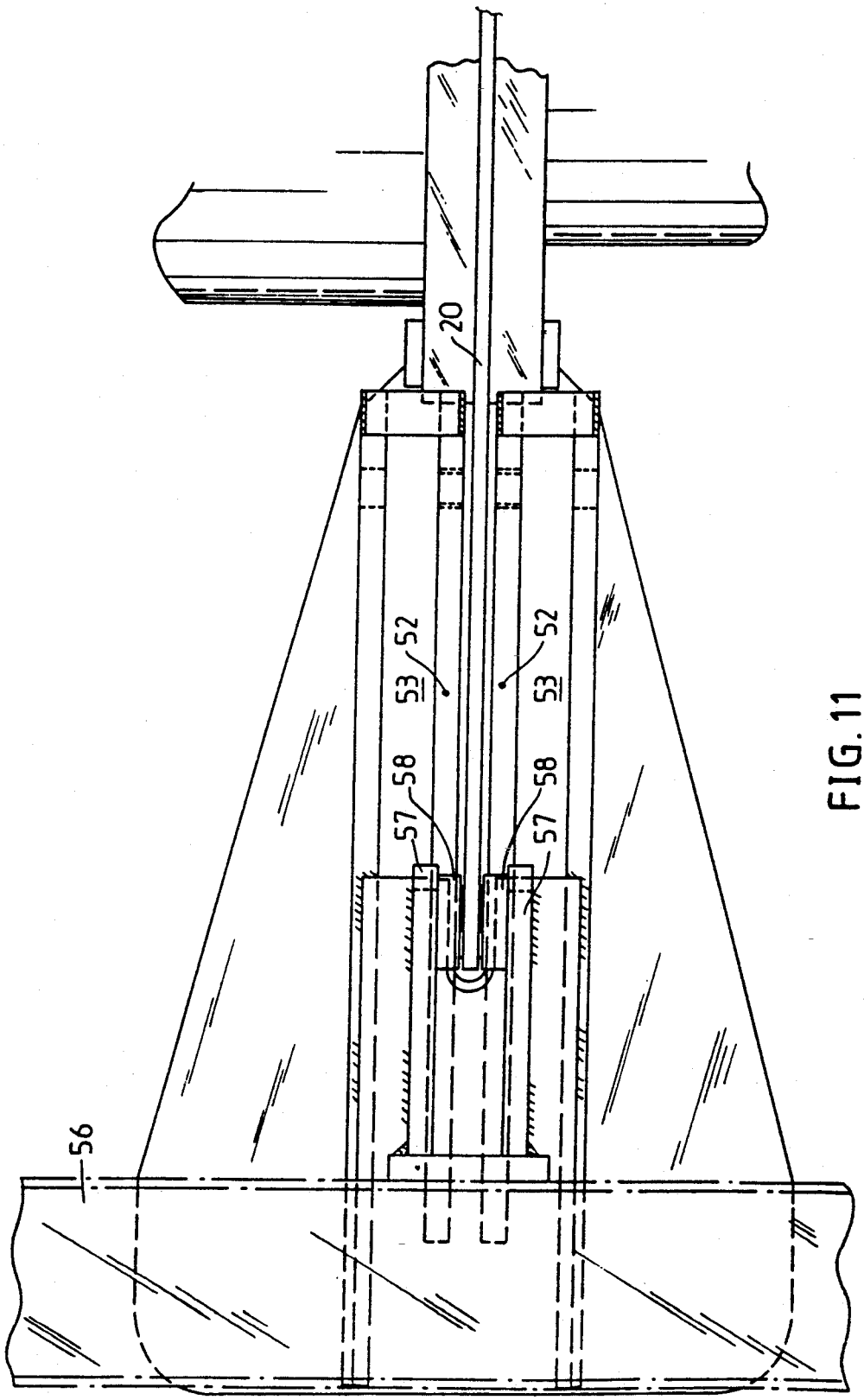
FIG. 11 is a plan view of the ice removal means of FIG. 9.

An embodiment of a harvesting blade assembly is shown in FIGS. 9–11. In this embodiment, harvesting blades 52 are fixed to the bottom edge of a respective one of a pair of radial arm members 53 which in turn are fixed to support plate 51 which is fastened by bolt 59 to cross beam 56 in the frame 12 of the ice making machine. The inner ends of arms 53 are supported by pendant arm 54 which is pivotally attached to bracket 55 on the machine frame. As this mounting arrangement is supported by the main frame rather than the shafts 18, 21, it eliminates pressure on bearings 23 and 25 and prolongs the life of such bearings.

The harvesting blade assembly shown in FIGS. 9–11 also comprises a bearing block 58 held between a pair of brackets 57 to maintain correct relative alignment between the disc 20 and the working edges of the harvesting blades 52.

The harvesting blade assembly is of simple economic construction yet is easy to adjust and to maintain. Moreover, the harvesting blade assembly harvests the ice on both sides of the disc 20 at the same angular location so that the forces on the disc are balanced.

Since ice is formed on both sides of the disc 20, the ice making machine of the present invention can be made more compact than known drum machines in which ice is formed on only one side of the drum. Moreover, as the freezing surfaces of the disc are in close proximity to the refrigerant, greater efficiency is achieved. The ice making machine has few moving parts, thereby requiring less maintenance than existing machines. In the event that maintenance is required, the disc/shaft/bearing assembly shown in FIG. 3 can easily be removed from the bearing mounts in the machine.

The machine can be started and stopped intermittently and the speed of the disc can be varied to produce products of different clarity and consistency. A single 500 mm diameter disc can produce over half a tonne of ice in a twenty-four hour period.

Figure 12:
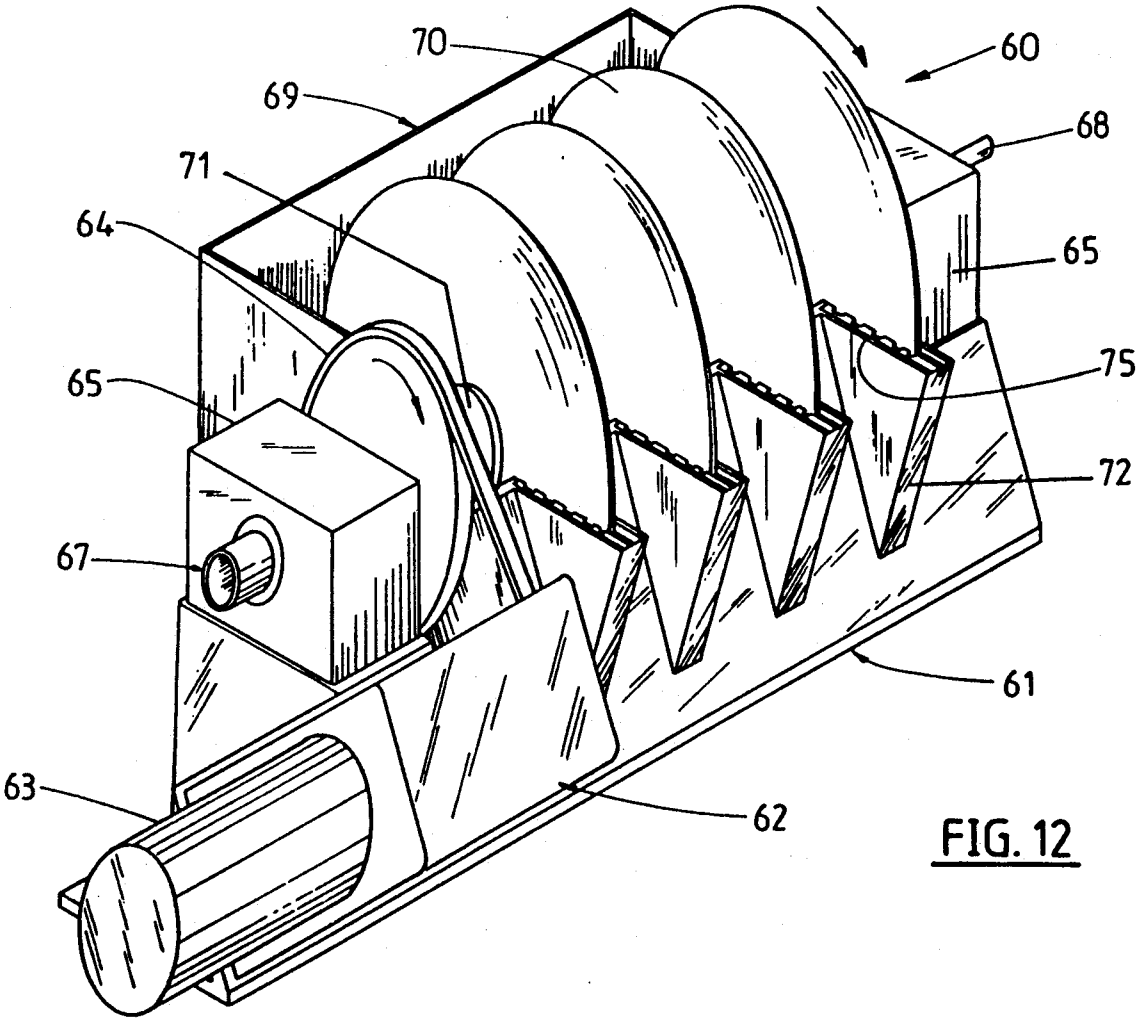
FIG. 12 is a perspective view of a multiple disc ice making apparatus according to another embodiment.
Figure 13:
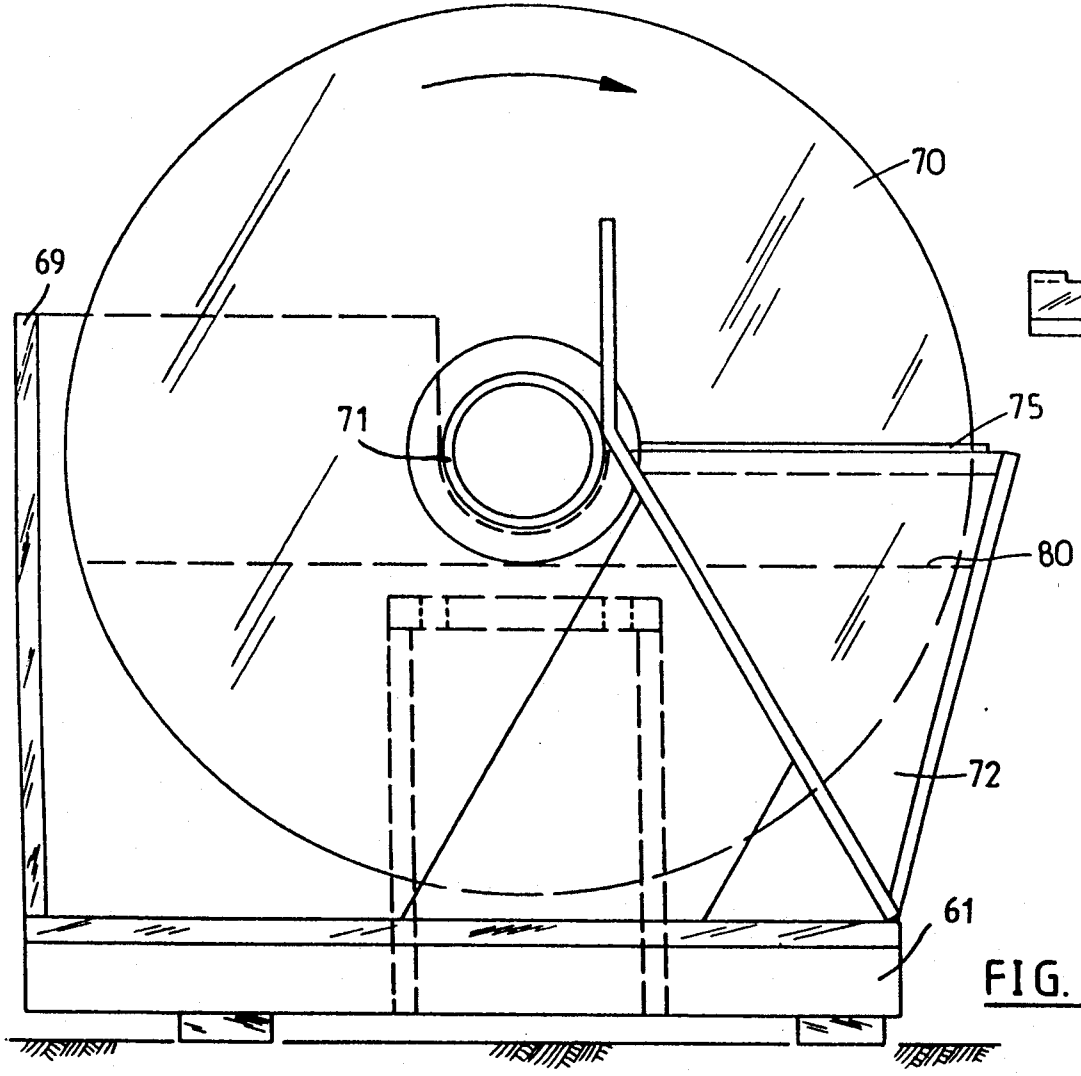
FIG. 13 is a sectional view of the multiple disc machine of FIG. 12.

Another embodiment of the present invention is illustrated in FIGS. 12 to 17, this embodiment utilising a plurality of refrigerated discs. As shown in FIGS. 12 and 13, the multi-disc ice making machine of the invention comprises a number of refrigerated discs 70 mounted on a common hollow shaft 71. The shaft 71 is mounted at its ends on combined bearing and seal assemblies 65. An inlet port 68 is provided at one end of the hollow shaft 71 for connection to a source of condensed liquid refrigerant, while the opposite end of the shaft 71 has an outlet port 67 for a suction connection for the evaporated refrigerant. The discs 70 constitute the evaporator of a refrigeration circuit in a similar manner to the embodiment of Figs. 1 to 11.

The discs 70 are mounted in a water tank 69, which typically is made of stainless steel or glass reinforced plastic. The tank 69 is mounted on a base 61, which is suitably made of cast aluminium alloy. Spaced pairs of flanges 72 are formed on the tank 69, each disc 70 passing between a respective pair of flanges 72. Scraper blades 75 are provided at the top of respective flanges 72 for fracturing the ice sheet formed on the discs 70 as the discs rotate past the blades.

The discs 70 and shaft 71 are rotated by a pulley or sprocket 64 coaxially mounted on the shaft 71 and driven, by chain or belt, by a drive motor 63 via a reduction gear box 62. However, it will be apparent to those skilled in the art that other means of rotating the discs 70 may be provided. For example, the pulley or sprocket 64, or one or more of the discs 70, may be provided with a toothed circumference and driven directly by a cog-wheel gear.

The tank 69 is filled with water to the level 80 as indicated in FIG. 13. As the disc 70 moves through the water in tank 69, a film of water will adhere to both surfaces of the disc due to surface tension. As the refrigerated disc 70 rotates in the clockwise direction as shown, the water adhering to the refrigerated surfaces of the disc will freeze to form a thin sheet of ice which is subsequently fractured from the disc surface by scraper blades 75 positioned as shown. Any water not adhering to the surface of the disc 70 or not being frozen will simply trickle back into the tank 69. Accordingly, there is little wastage of the liquid to be frozen.

Ice production can be increased by reducing the temperature of water in tank 69 to close to freezing point, increasing the speed of rotation of disc 70 and increasing the flow of refrigerant through the disc 70.

The design and construction of each refrigerated disc is substantially as hereinbefore described with reference to FIGS. 4–6.

Figure 14:
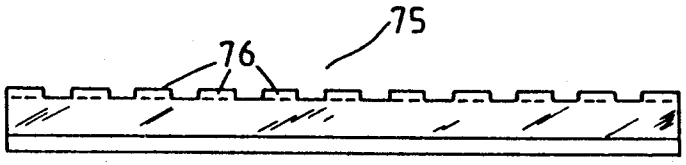
FIG. 14 is a plan view of the ice removal means of FIG. 12.
Figure 15:
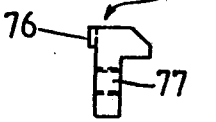
FIG. 15 is a side view of the ice removal means of FIG. 14.

An exemplary form of the scraper blade is illustrated in FIGS. 14 and 15. Each scraper blade 75 is removably mounted on top of its respective flange 72 by suitable fasteners through holes 77. Each scraper blade 75 comprises a series of teeth 76 for fracturing the sheet ice from the refrigerated surfaces of the discs 70. The scraper blades are hardened and tempered to resist wear. The only substantial wear in the machine is the abrasion of the ice against the scraper blades, and the scraper blades 75 can easily be removed for replacement and/or resharpening.

Figure 16:
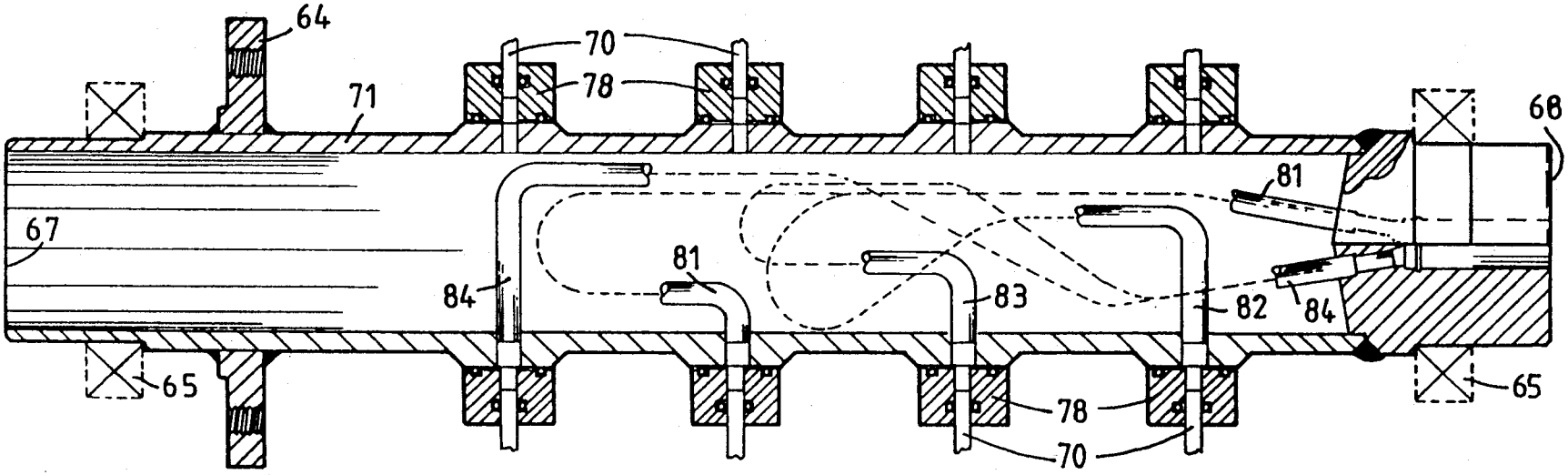
FIG. 16 is a sectional view of the shaft of FIG. 12.
Figure 17:
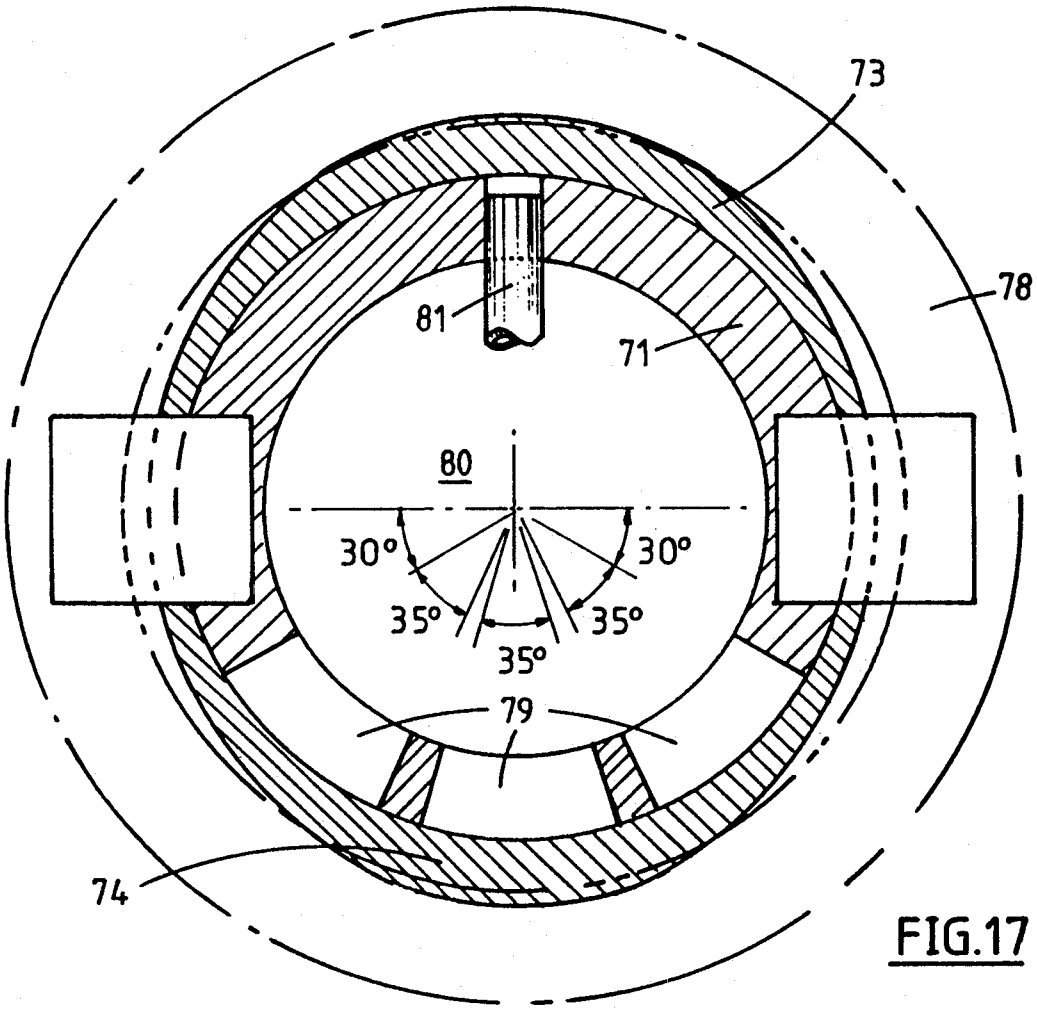
FIG. 17 is a sectional view of the disc mounting on the shaft of FIG. 16.

The feeding of refrigerant to the discs 70 is illustrated in FIGS. 16 and 17. A four-way liquid refrigerant distributor is provided at the inlet port 68 of the hollow shaft 71. The four-way distributor comprises four copper distributor tubes 81–84 which communicate with the channels in respective discs 70. The lengths of the distributor tubes 81–84 from the inlet port 68 to their respective discs 70 are made equal in order to obtain equal pressure drop in the refrigerant feed to each disc.

The delivery end of each distributor tube 81–84 is received in a radial bore in a respective collared portion of the hollow shaft 71 on which an associated disc 70 is mounted. Each disc 70 is mounted to a collared portion by means of a clamping ring-nut 78. An internal elliptical bore is formed in the centre of each clamping ring-nut 78 to provide an inlet chamber 73 between the delivery end of the respective delivery tube 81–84 and the channels in the associated disk. Refrigerant delivered through tubes 81–84 fills the receptive chambers 73 which communicate with the channel openings 31 of each respective disc 70. Refrigerant flows through the channels 30 of each respective disc whereat it is evaporated to cool the discs. The evaporated refrigerant is extracted via the channel outlets which communicate with a suction chamber 74 formed between the shafts 71 and the disc 70 by the elliptical aperture in the clamping ring-nut 78. The suction chamber 74, in turn, communicates with the interior of the hollow shaft 71 via slots 79 cut into the shaft 71. The refrigerant is extracted from the interior 80 of the hollow shaft 71 via the outlet port 67 for delivery to the compressor of the refrigeration circuit.

The foregoing describes only some embodiments of the present invention and modifications which are obvious to those skilled in the art may be made thereto without departing from the scope of the invention. For example, although a circular disc is preferred, the ice making machine may use a disc of other shape such as hexagonal or octagonal. The construction of the disc can be varied to include more than two layers bonded or brazed together, or alternatively, the disc can be manufactured by sandwiching a pipe coil between two flat metal discs.

In an alternative embodiment of the invention (not illustrated), the disc is held stationary and the ice removed by a rotating blade. The blade can be fitted with water application means on its trailing side so that as the leading edge removes the ice from the disc, the trailing edge leaves a layer of water which freezes by the time that the leading edge completes a full revolution. The water application means can take the form of a series of water jets or sprays.

While the ice making machines have been described with particular reference to flake ice manufacture, the invention is not limited thereto. For example, the ice making machines of the present invention may also be used to manufacture a slush ice product from fruit juice or cordial. On a larger scale, the machines could also be used to make imitation snow.

We claim:

1. Apparatus for creating flake ice comprising, a frame, means on said frame defining a reservoir serving to contain a supply of liquid for conversion into flake ice, at least one disc member rotatably mounted on said frame and arranged for partial immersion in the liquid supply contained in the reservoir in a manner such that both sides of the disc member are exposed to the liquid as the disc member rotates, means serving to rotate the disc member, said disc member having relatively narrow internal channels therein serving to receive an evaporative refrigerating coolant therein for passage therethrough, ice removing means arranged on said frame above the reservoir for removing from each side of the disc member flake ice as the disc member rotates, and flake ice receiving means positioned for receiving the flake ice removed by said ice removing means from the disc member.

2. Ice making apparatus of claimed in claim 1, wherein said rotatable disc member is provided with a central aperture, a collar member mounted in said central aperture, shaft means associated with said collar and having passageways therein for conducting the evaporative refrigerant to and from the disc member, said collar member having a first plurality of radial bores which communicate at their inner ends with a first fluid passageway in said shaft and at their outer ends with inlets to the channels in the disc member, said collar member having a second plurality of radial bores having their outer ends communicating with outlets of the channels in the disc member and having their inner ends communicating with a second fluid passageway in said shaft.

3. Ice making apparatus as claimed in claim 1 wherein said apparatus includes, a plurality of refrigerated disc members mounted on a common hollow shaft having an inlet and outlet ends, a plurality of coolant delivery tubes each extending between said inlet end and the respective mounting of each said disc members on said shaft, said delivery tubes being substantially of equal length, said shaft having apertures therein at the mounting of each respective disc member serving to provide coolant communication between the outlets of the channels in the respective disc members and the interior of said shaft.

4. The ice making apparatus of claim 1 wherein said relatively narrow internal channels in said disc member are substantially of equal length.

5. The ice making apparatus of claim 1 wherein said disc member is of laminate construction and comprises at least two disc portions in which open channels have been formed in respective patterns which are mirror images of each other, said disc portions being bonded together to form said disc member, said internal channels being formed by opposed open channels.

6. The apparatus of claim 5 wherein said open channels are formed in said disc portions by etching.

7. The apparatus of claim 1 wherein said removing means includes blade-like means disposed proximate the sides of said disc member for engaging and removing the ice therefrom.

8. A method of forming flake ice comprising the steps providing a refrigeration system operative with an evaporative or "boiling" working fluid and including an evaporator, the evaporator comprising at least one rotatable disc member having a plurality of relatively narrow internal channels therein sized to accommodate the passage therethrough and expansion therein of the evaporative coolant, applying liquid to be frozen to both sides of the exterior of the disc member by partially immersing in a liquid to be frozen a lower segment of the disc member while simultaneously supplying to the interior of the disc the evaporative coolant to thereby cause the liquid on the exterior of the disc member to form ice, rotating the disc member while removing the ice from the sides of the disc member.

* * * * *